US006918526B1

(12) United States Patent
Huang

(10) Patent No.: US 6,918,526 B1
(45) Date of Patent: Jul. 19, 2005

(54) MUFFLER FOR STAPLE GUNS

(76) Inventor: Wen-Sheng Huang, No. 441-2, Ta Li Road, Ta Li City, Taichung (TW)

( * ) Notice: Subject to any disclaimer, the term of this patent is extended or adjusted under 35 U.S.C. 154(b) by 0 days.

(21) Appl. No.: 10/854,207

(22) Filed: May 27, 2004

(51) Int. Cl.[7] ..... B25C 1/04

(52) U.S. Cl. ..... 227/130; 173/DIG. 2; 173/169; 181/156; 181/230; 137/849; 138/46; 91/432; 60/469

(58) Field of Search ..... 227/130; 173/DIG. 2; 181/71, 156, 258, 275, 230; 137/849; 138/45, 138/46; 91/432; 60/469

(56) References Cited

U.S. PATENT DOCUMENTS

| | | | | | |
|---|---|---|---|---|---|
| 1,575,657 | A | * | 3/1926 | Straussler | 181/258 |
| 2,593,315 | A | * | 4/1952 | Kraft | 138/45 |
| 2,688,979 | A | * | 9/1954 | Kendrick | 137/512.15 |
| 2,950,775 | A | * | 8/1960 | Zwayer | 181/230 |
| 3,174,434 | A | * | 3/1965 | Schieve | 415/146 |
| 3,384,200 | A | * | 5/1968 | Baker et al. | 181/230 |
| 3,880,245 | A | * | 4/1975 | Anderson, Jr. | 173/219 |
| 3,895,646 | A | * | 7/1975 | Howat | 137/468 |
| 3,970,168 | A | * | 7/1976 | Mucka | 181/238 |
| 3,999,624 | A | * | 12/1976 | Treftc et al. | 181/269 |
| 4,308,885 | A | * | 1/1982 | Geisseler | 137/67 |
| 5,340,291 | A | * | 8/1994 | Benckert et al. | 417/569 |
| 5,500,494 | A | * | 3/1996 | Ligman | 181/230 |
| 5,592,966 | A | * | 1/1997 | Gates | 137/513.5 |
| 5,890,959 | A | * | 4/1999 | Pettit et al. | 454/184 |
| 6,089,346 | A | * | 7/2000 | Tredinnick et al. | 181/230 |
| 6,149,356 | A | * | 11/2000 | Chu et al. | 408/56 |
| 6,202,785 | B1 | * | 3/2001 | Hilling et al. | 181/230 |
| 6,209,678 | B1 | * | 4/2001 | Sterling | 181/230 |

* cited by examiner

*Primary Examiner*—Stephen F. Garrity
*Assistant Examiner*—Thanh Truong

(57) ABSTRACT

A muffler is received in a passage of an end member connected to a handle of the staple gun and a fitting extends from the end member so as to be connected to a hose. The muffler includes a tubular body and a plurality of plates extend from an end of the tubular body. The plats extend toward an interior of the handle and form a bullet-head-shaped arrangement. Gaps are defined between the plates and become smaller when air goes outward from the handle so as to reduce noise.

4 Claims, 4 Drawing Sheets

MUFFLER FOR STAPLE GUNS

FIELD OF THE INVENTION

The present invention relates to a muffler received in the handle so as to reduce the noise when disengaging the hose from the hose fitting on the handle of the staple gun.

BACKGROUND OF THE INVENTION

A staple gun is powered by a compressor which introduces pressurized air into the body of the staple gun so as to eject staples from a noise at a front end of the staple gun. The compressor is connected to the staple gun by a hose which is connected to a fitting extending from the handle of the staple gun. When the user disengages the hose from the fitting of the staple gun, the high pressure of the air in the body of the staple gun suddenly releases from the fitting and make a huge noise which is harmful for the users. In order to improve the inherent shortcoming, a muffler is connected to the handle and includes a plurality of escape holes through which the pressurized air escapes. Nevertheless, the muffler increases the time required to fill the body of the staple gun with the pre-set pressure so that the user has to wait a while to connect the hose to the fitting. This is not satisfied by the users who expect the staple guns to be ready for use whenever they need.

The present invention intends to provide a muffler for a staple gun wherein the muffler is received in the fitting and includes several plates between which gaps are defined. The gaps become smaller by the outgoing air so that the noise is reduced.

SUMMARY OF THE INVENTION

The present invention relates to a noise reducing device for a staple gun and comprises an end member connected to the handle and having a fitting for being connected to a hose. A muffler comprises a tubular body which is received in a passage in the end member and a plurality of plates extend from an end of the tubular body. The plats extend toward an interior of the handle and gaps are defined between the plates. The gaps become smaller when air in the handle goes outward.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 2:
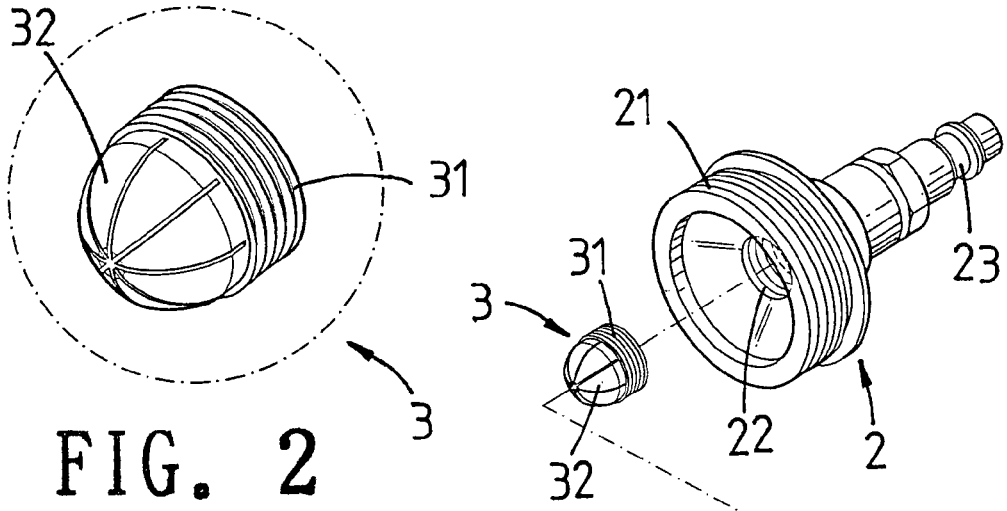
FIG. 2 shows the muffler of the present invention.
Figure 1:
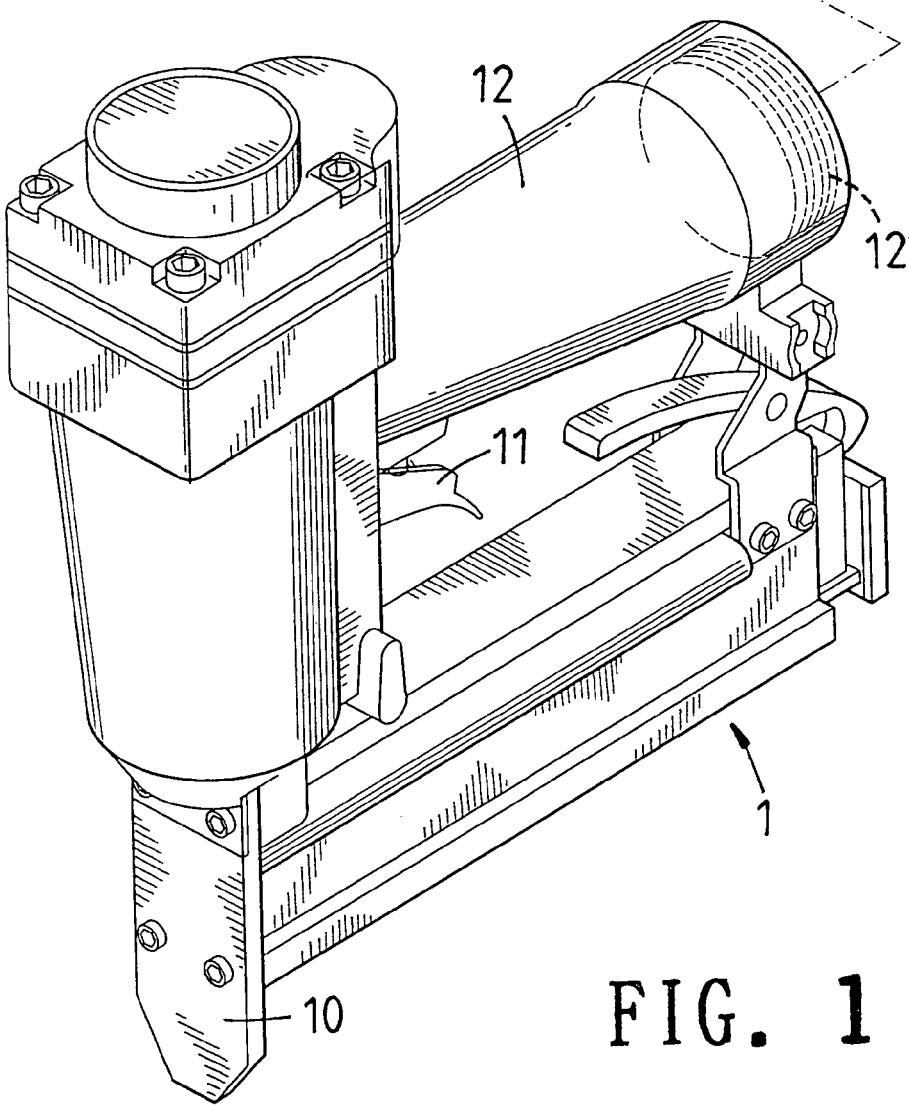
FIG. 1 is an exploded view to show the muffler, the end member and the staple gun of the present invention.
Figure 3:
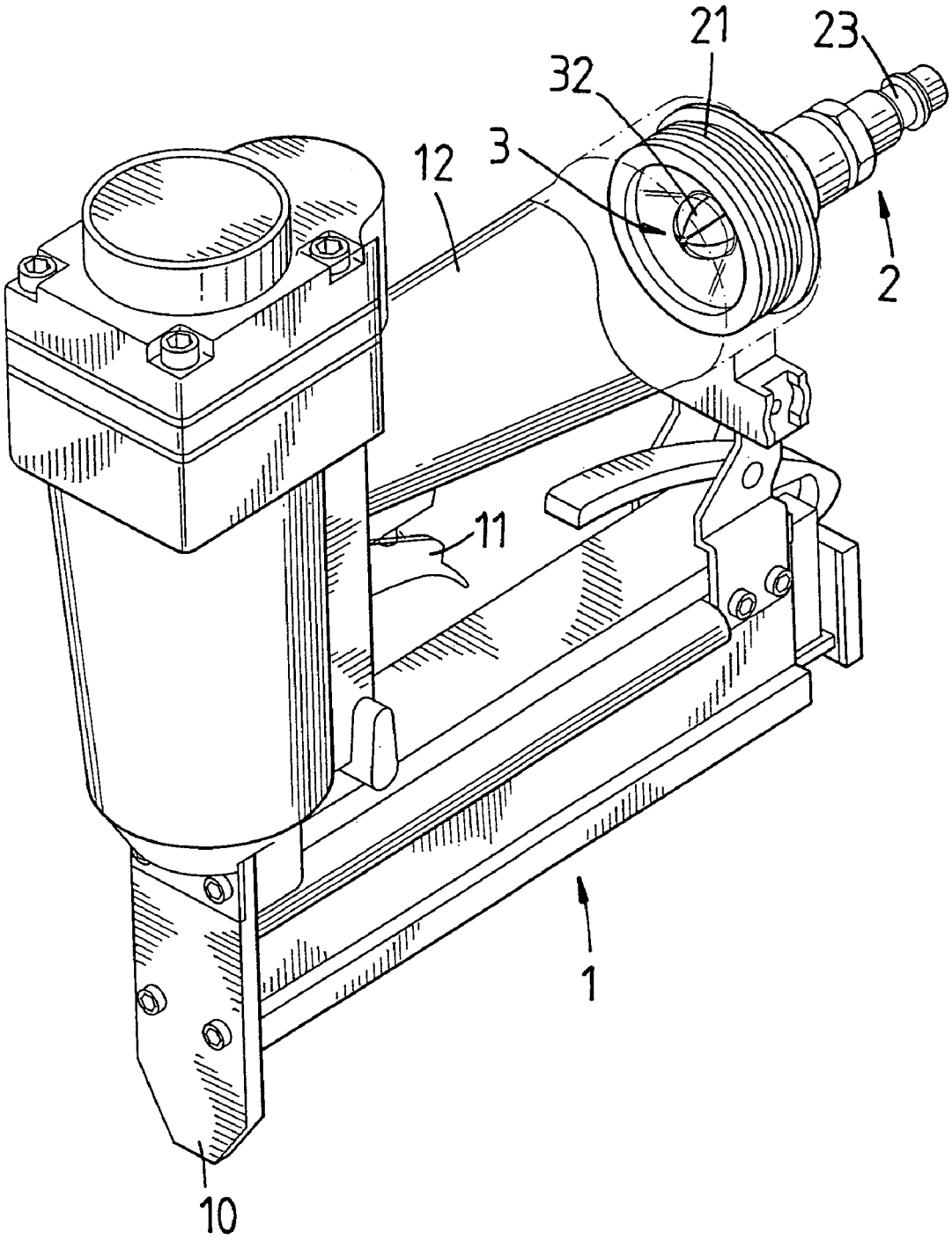
FIG. 3 is a perspective view to show the muffler received in the end member of the staple gun.

Referring to FIGS. 1 to 3 and 6, the noise reducing device for a staple gun 1 of the present invention comprises an end member 2 which has a threaded connection end 21 and a fitting 23 extends from the other end of the end member 2. The threaded connection end 21 is threadedly connected to a threaded hole 121 of the handle 12 of the staple gun 1 and a passage is defined through the end member 2 and communicates with the fitting 23 which is connected to a hose from a compressor (both are not shown). The staple gun 1 comprises a body with a nose 10 connected to a front end thereof and a magazine is connected to the nose 10. A trigger is pivotably connected to the handle 12 so as to activate the valve mechanism in the handle 12 to allow the pressurized air to eject the staples out from the nose 10.

A muffler 3 comprises a tubular body including a threaded outer periphery 31 which is engaged with the threaded inner periphery 22 defined in the passage of the end member 2. A plurality of plates 32 extend from an end opposite to the end having the threaded outer periphery 31 of the tubular body, and the plats 32 extend toward an interior of the handle 12. The plates 32 are located side by side so as to form a bullet-head-shaped arrangement and a hole is defined in a center enclosed by respective tips of the plates 32. Gaps are defined between the plates 32.

Figure 4:
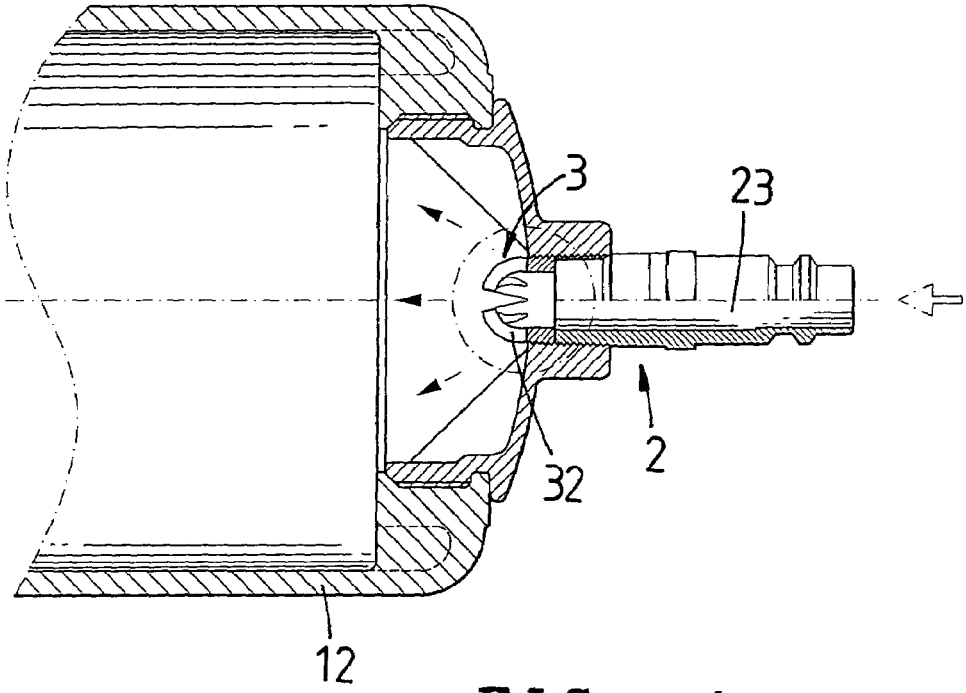
FIG. 4 shows the plates of the muffler are blown outward by air coming into the handle of the staple gun.
Figure 5:
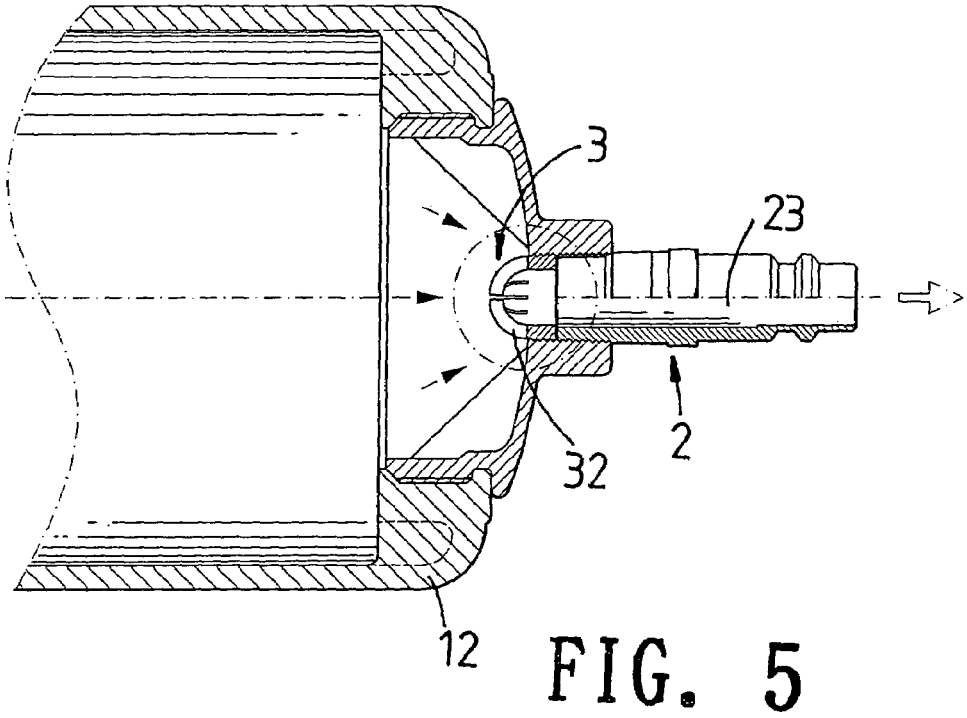
FIG. 5 shows the plates of the muffler are blown inward by air going out from the handle of the staple gun.
Figure 6:
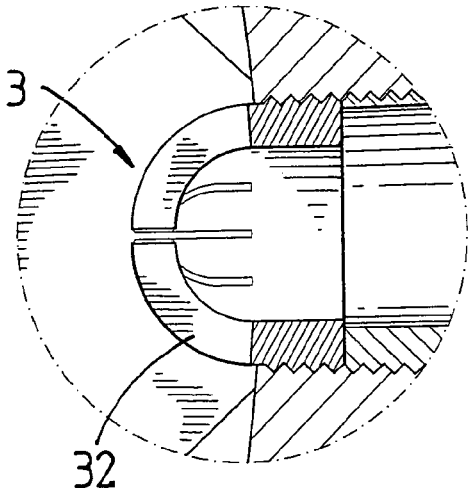
FIG. 6 is an enlarged view to show the stationary status of the plates of the muffler.
Figure 7:
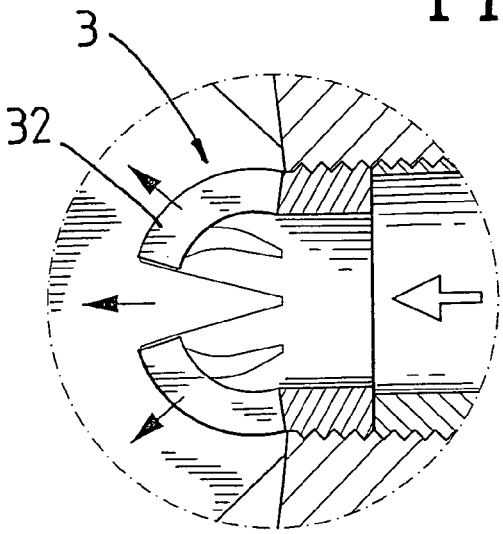
FIG. 7 is an enlarged view to show that the plates are blown outward by air coming into the handle of the staple gun.
Figure 8:
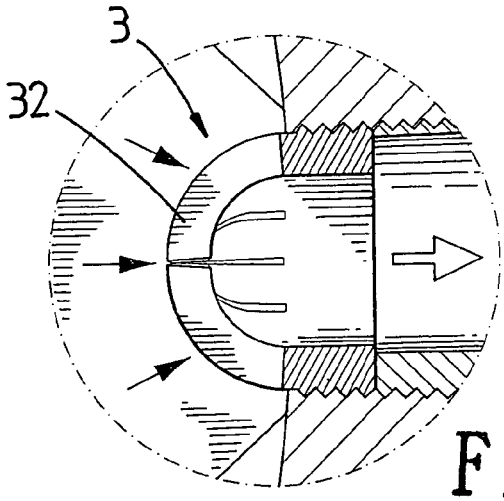
FIG. 8 is an enlarged view to show that the plates are blown inward by air going out from the handle of the staple gun.

As shown in FIGS. 4 and 7, when the air provided by the compressor enters into the staple gun 1 via the fitting 23, the plates 23 are expanded outward so that the air enters into the staple gun 1 quickly. As shown in FIGS. 5 and 8, when disengaging the hose from the fitting 23, the pressurized air in the staple gun 1 pushes the plates 32 and the gaps become smaller. The speed of the air is reduced and makes less noise. It is noted that the pressure in the staple gun 1 is limited and the material of the plates 32 is chosen and set to be stiff enough to bear the pressure from the air and will not be folded inward so that the plates 32 are pushed to be close together and the gaps are narrowed.

While we have shown and described the embodiment in accordance with the present invention, it should be clear to those skilled in the art that further embodiments may be made without departing from the scope of the present invention.

What is claimed is:

1. A noise reducing device for a staple gun which comprises a body with a nose connected to a front end thereof and a trigger pivotably connected to a handle of the staple gun, the device comprising:

an end member adapted to be connected to the handle and having a fitting extending therefrom, a passage defined through the end member and communicating with the fitting, and a muffler comprising a tubular body which is received in the passage of the end member and a plurality of plates extending from an end of the tubular body, the plates adapted to extend toward an interior of the handle, gaps defined between the plates, and the gaps between the plates are smaller when air exits end member.

2. The device as claimed in claim 1, wherein the plates are located side by side so as to form a domed shaped arrangement.

3. The device as claimed in claim 2, wherein a hole is defined in a center encompassed by respective tips of the plates.

4. The device as claimed in claim 1, wherein the passage of the end member includes a threaded inner periphery and the tubular body of the muffler includes a threaded outer periphery which is engaged with the threaded inner periphery of the end member.

* * * * *